US008499708B2

(12) United States Patent
Roodenburg et al.

(10) Patent No.: US 8,499,708 B2
(45) Date of Patent: Aug. 6, 2013

(54) HEAVE COMPENSATION SYSTEM AND METHOD

(75) Inventors: Joop Roodenburg, Delft (NL); Cornelis Johannes Ekelaar, Rotterdam (NL)

(73) Assignee: ITREC B.V., Schiedam (NL)

( * ) Notice: Subject to any disclaimer, the term of this patent is extended or adjusted under 35 U.S.C. 154(b) by 17 days.

(21) Appl. No.: 12/934,500

(22) PCT Filed: Mar. 26, 2009

(86) PCT No.: PCT/NL2009/000070

§ 371 (c)(1),
(2), (4) Date: Dec. 10, 2010

(87) PCT Pub. No.: WO2009/120066

PCT Pub. Date: Oct. 1, 2009

(65) Prior Publication Data

US 2011/0100279 A1 May 5, 2011

(30) Foreign Application Priority Data

Mar. 26, 2008 (NL) ..... 2008/000091

(51) Int. Cl.
*B63B 39/02* (2006.01)
*B66C 23/53* (2006.01)

(52) U.S. Cl.
USPC ..... 114/124; 212/308

(58) Field of Classification Search
USPC ..... 114/124; 212/307, 308
See application file for complete search history.

(56) References Cited

U.S. PATENT DOCUMENTS

| | | | | |
|---|---|---|---|---|
| 3,054,310 | A * | 9/1962 | Varner | 72/11.8 |
| 4,352,023 | A * | 9/1982 | Sachs et al. | 290/42 |
| 5,965,994 | A * | 10/1999 | Seo | 318/280 |
| 6,932,325 | B1 * | 8/2005 | Selcer et al. | 254/275 |
| 7,573,143 | B2 * | 8/2009 | Frayne | 290/1 R |
| 2001/0003963 | A1 * | 6/2001 | Chaix | 114/124 |
| 2005/0242332 | A1 * | 11/2005 | Ueki et al. | 254/277 |

FOREIGN PATENT DOCUMENTS

| | | | |
|---|---|---|---|
| GB | 1 577 744 | A | 10/1980 |
| WO | WO 2004/016497 | A1 | 2/2004 |
| WO | WO 2007/060189 | A1 | 5/2007 |

OTHER PUBLICATIONS

"Active heave compensation winches offer low weight, power consumption", Winch Technology, vol. 2212, 2001, p. 140, XP-001116711, Oct. 2001.

* cited by examiner

*Primary Examiner* — Stephen Avila
(74) *Attorney, Agent, or Firm* — Birch, Stewart, Kolasch & Birch, LLP

(57) ABSTRACT

A heave compensation system comprises a motor-generator to interact with a load and a control unit being arranged to control operation of the motor-generator. The control unit is arranged to: operate the motor-generator to drive the load in a first part of a wave motion cycle, and operate the motor-generator to regenerate in a second part of the wave motion cycle at least a part of the energy with which the load has been driven in the first part of the wave motion cycle. The heave compensation system comprises an electrical storage element to buffer at least part of the regenerated energy for powering the motor-generator in a following cycle of the wave motion.

20 Claims, 5 Drawing Sheets

HEAVE COMPENSATION SYSTEM AND METHOD

The invention relates to an active heave compensation system and to an active heave compensation method.

Heave compensation has been known for many years. Many solutions have been provided, some of which will be discussed below. In general, heave compensation provides for a compensation of wave motion on a load. The load may be submerged or partially submerged, thereby being subjected to the wave motion. Also, or instead thereof, it may be the case that the load is held by a floating platform (such as a ship), which is subjected to the wave motion. Further, many other cases may be imaginable where heave motion may be desired, such as a situation where a load is to be taken from or placed on a floating platform, the floating platform being subjected to wave motion. Heave compensation may be provided for any kind of load, e.g. a load to be carried by a crane or other lifting installation, constructions submerged under water such as pipeline laying equipment, etc. It is to be understood that the above examples are for illustration only, and are not intended to limit the scope of this document in any way.

Heave compensation systems can be subdivided inactive and passive heave compensation systems. Combinations of active and passive systems may be provided too. In a passive heave compensation system, a compressible medium is provided in a form of a gas spring, hydraulic system, etc. to provide for a compensation. In an active heave compensation system an actuator is provided to actively compensate for effects of the wave motion. Many constructions have been described in the literature. In general, in an active heave compensation system, use is made of a hydraulic system. As an example, a hydraulic cylinder may be provided which extends and compresses synchronously with the wave motion, thereby interacting with for example a cable holding the load. In each wave, energy is to be supplied to the hydraulic system to exert a force onto the load. Some of the energy may be regained in the other part of the heave motion cycle and e.g. stored by compression of a gas. In the next cycle, the compressed gas can then be applied to drive the load or at least to contribute thereto.

Although hydraulic/gas pressure active heave compensation has been extensively used in many configurations, a disadvantage is that this setup leads to a complex system and involves a risk of leakage of hydraulic fluid, resulting on the one hand in a relatively complex and costly system, while on the other hand requiring regular and secure maintenance to avoid leakage and risks of environmental pollution caused thereby.

In order to at least partly compensate the above-mentioned drawbacks of active heave compensation systems, the inventors have devised an active heave compensation system comprising a motor-generator to interact with a load and a control unit which is arranged to control operation of the motor-generator, the control unit being arranged to:

- operate the motor-generator to drive the load in a first part of a wave motion cycle, and
- operate the motor-generator to regenerate in a second part of the wave motion cycle at least a part of the energy with which the load has been driven in the first part of the wave motion cycle, the active heave compensation system comprising an electrical storage element to buffer at least part of the regenerated energy for powering the motor-generator in a following cycle of the wave motion.

The active heave compensation system according to the invention thus comprises a combination of a motor-generator and an electrical storage element. In a first part of the wave motion cycle, the motor-generator acts as a motor and drives the load. In a second part of the wave motion cycle, energy is regained and the motor-generator acts as a generator thereby regenerating at least part of the energy with which the load has been driven in the first part of the wave motion cycle. The regenerated energy is stored in the electrical storage element. The stored energy can now be used in a first part of a following wave motion cycle to power the motor-generator. Within the scope of the invention, for the motor-generator, use can be made of a separate motor and a separate generator which both interact with the load, however in an advantageous embodiment, use is made of a motor type which acts as a generator, thus a motor which, when not provided with electrical energy, but when mechanically driven by a corresponding motion of the load, generates electrical energy thereby acting as a generator. Any type of motor-generator may be provided, as an example, use may be made of an three-phase asynchronous motor. The term motor-generator may in general terms be defined as an arrangement which is adapted to convert electrical energy into motion and to convert motion into electrical energy. Any type of electrical storage element can be used, however it is preferred that a capacitor is applied as a capacitor can provide for a low loss storage, thereby enhancing energy efficiency of the heave compensation system. Preferably, the capacitor comprises a super capacitor, as thereby a high capacitance value, and consequently a high energy storage capacity can be provided in a comparably small volume. Furthermore, a super capacitor may provide for a low series resistance, hence allowing a low loss energy storage, may allow a quick charging and discharging, may provide a high efficiency, and may provide a long operating life. Also a combination of a battery and capacitor, such as a super capacitor can be used as electrical storage element. While a capacitor can provide a high output energy and a battery can provide energy during a relatively long period, a combination could benefit from both features.

According to the invention, a control unit may be provided to control the motor-generator so as to drive the load in a first part of the wave motion cycle and to regenerate energy in the second part of the wave motion cycle. The control unit (comprising e.g. a microcontroller, microprocessor, or any programmable logic device, e.g. being provided with suitable program instructions to perform the actions as described) may thereto e.g. control a power supply associated with the motor-generator. The control unit may thereby control the power supply such as to power the motor-generator to drive the load in the first part of the cycle and to regenerate at least part of the energy in the second part of the cycle.

The storage element, such as the super capacitor, can be electrically connected in many ways. An advantageous configuration is achieved when the storage element is electrically connected parallel to a electrical power source to power the motor-generator. The power source may e.g. be formed by a mains voltage, a supply voltage of an installation in which the active heave compensation system is comprised, etc. Thereby, peaks on the power supply a voltage of the electrical power source true to the drawing of electrical power in the first part of the wave motion cycle and the regeneration in the second part of the wave motion cycle may be reduced due to a buffering of the electrical power source by the storage element, in particular the super capacitor.

In another advantageous embodiment, a converter may be provided which is electrically connected between the motor-generator and the storage element. The converter may convert a motor-generator voltage into a charging respectively discharging voltage of the storage element and vice versa. The converter may thereby provide for a voltage level conversion to take account of a difference in voltage level of the motor-generator or other element of the power supply, and the storage element. In particular, when making use of a capacitor, such as a super capacitor in the storage element, the converter may provide for a conversion towards a suitable charging voltage of the capacitor/super capacitor and for a discharging thereof, possibly allowing the (super) capacitor to be used over a wide voltage range, and thus over a wide charging/discharging range. The converter may comprise any suitable converter, in a preferred embodiment a bidirectional direct current-direct current converter, such as a switching converter may be applied, as thereby a low loss conversion may be provided.

Where in this document reference has been made to a capacitor or a super capacitor, this may be understood such as to include a plurality of capacitors/super capacitors, connected in series, connected in parallel, or any combination thereof.

When the storage element comprises a plurality of (super) capacitors, the converter may comprise a switching network to switch the capacitors in series and/or parallel combinations. Thereby, a low loss conversion may be provided: as an example, the lower the voltage provided to the converter for charging the capacitors, the more capacitors are put in parallel, while the higher the voltage provided to the converter, the more capacitors are connected in series. Thereby, by switching the capacitors to be in series/parallel configurations, an operating voltage range of the individual capacitors may be adapted to the voltage provided for charging. For discharging, the same principle may be applied.

In another embodiment when applying a (super) capacitor as the storage element, the converter may comprise an inductor to form an inductor-capacitor resonance circuit with the super capacitor. To obtain optimum results, a resonance frequency of the resonance circuit may be adapted to a cycle frequency of the wave motion. Thereby, a low loss conversion may be provided, in particular when the resonance frequency has been adapted to the cycle frequency of the wave motion, as thereby the cycle of providing energy and storing regenerated energy may be synchronised with the resonance mode of the resonance circuit.

The control unit may comprise a voltage measurement device for measuring a voltage of the power source. The control unit may thereby be arranged to compare the measured voltage with a low and a high threshold voltage value for driving the converter in order to charge the electrical storage element when the voltage exceeds the high threshold voltage value, and in order to discharge the electrical storage element when the measured voltage succeeds the low threshold value. Thereby, a simple control algorithm may be provided, as in case of a low supply voltage, i.e. in case of a high current drawn by the motor, the electrical storage element is discharged, thereby providing energy for driving the motor-generator, and in case that the power supply voltage is high, indicating that energy is regenerated by the motor-generator, the converter is operated to charge the (super) capacitor, thereby storing regenerated energy.

Alternatively, the control unit may comprise a current measurement device for measuring a current, provided by the power source. The control unit may thereby be arranged for comparing the measured current with a current set point, for driving the converter in order to discharge the electrical storage element when the measured current exceeds the current set point and in order to charge the electrical storage element when the current set point exceeds the measured current. A simple control algorithm may be provided, and in case of a high supply current, i.e. in case of a high current drawn by the motor, the electrical storage element is discharged, thereby providing energy for driving the motor-generator. In the case that the power supply current is low, indicating that energy is regenerated by the motor-generator, the converter is operated to charge the (super) capacitor, thereby storing regenerated energy.

In a further, advantageous embodiment, the control unit may be arranged to measure an operating voltage of the electrical storage element and to connect an electrical power dissipater when the operating voltage of the storage element exceeds a maximum operating voltage, thereby preventing the storage element from being overloaded by dissipating part of the energy stored therein in case that a maximum voltage is exceeded. In another embodiment, the excess energy may be fed back to the power supply. It may be advantageous to use the energy on other places on board of the ship In a further embodiment, the control unit is arranged for comparing a time average of the voltage of the storage element with a predefined storage voltage set point. The predefined storage voltage set point represents the desired operating voltage of the storage element. It may be expected that the average operating voltage of the storage element will decrease, as in each cycle of the wave motion energy will be dissipated in cables and inside the motor-generator. When, in that case, the control unit may modify the current set point, the control unit may drive the power source to provide energy to compensate for the losses.

In another embodiment of the invention, the control unit comprises a measurement device for measuring a variable, representative of a heave motion, which is to be compensated. This variable can be, among others, a wave related variable, a heaving related variable or a motor-generator related variable. This can relate to any suitable parameter, such as a depth of the water as measured by a suitable sensor such as an ultrasound sensor, an acceleration of the cable, load etc as measured by an acceleration sensor, an angle of the cable etc as measured by an angle meter, or an air speed velocity as measured by an air speed meter. The control unit is arranged for driving the converter in order to charge or discharge the electrical storage element to provide or to buffer at least a part of the electrical energy involved with the heave compensation on the basis of the measured variable. The control unit can also be arranged for driving the power source to provide or to receive at least a part of the electrical energy involved with the heave compensation. Thereby, the storage element and/or the power source may quickly start to supply or buffer the energy involved with the heave motion compensation, resulting a better heave compensation or lower energy losses.

The same or similar advantages and preferred embodiments as achieved with the heave compensation system according to the invention, may also be provided by a heave compensation method according to the invention. The method according to the invention provides an active heave compensation method for at least partly compensating for an effect of a wave motion on a load, the method comprising:

- operating a motor-generator which interacts with the load to drive the load in a first part of a wave motion cycle, and
- operating the motor-generator to regenerate in a second part of the wave motion cycle at least a part of the energy with which the load has been driven in the first part of the wave motion cycle, wherein at least part of the regenerated energy is buffered in an electrical storage element, for powering the motor-generator in a following cycle of the wave motion.

Further features effects and advantages of the invention will become clear from the appended drawings and corresponding description, in which non-limiting embodiments of, invention are disclosed, wherein.

Figure 9A:
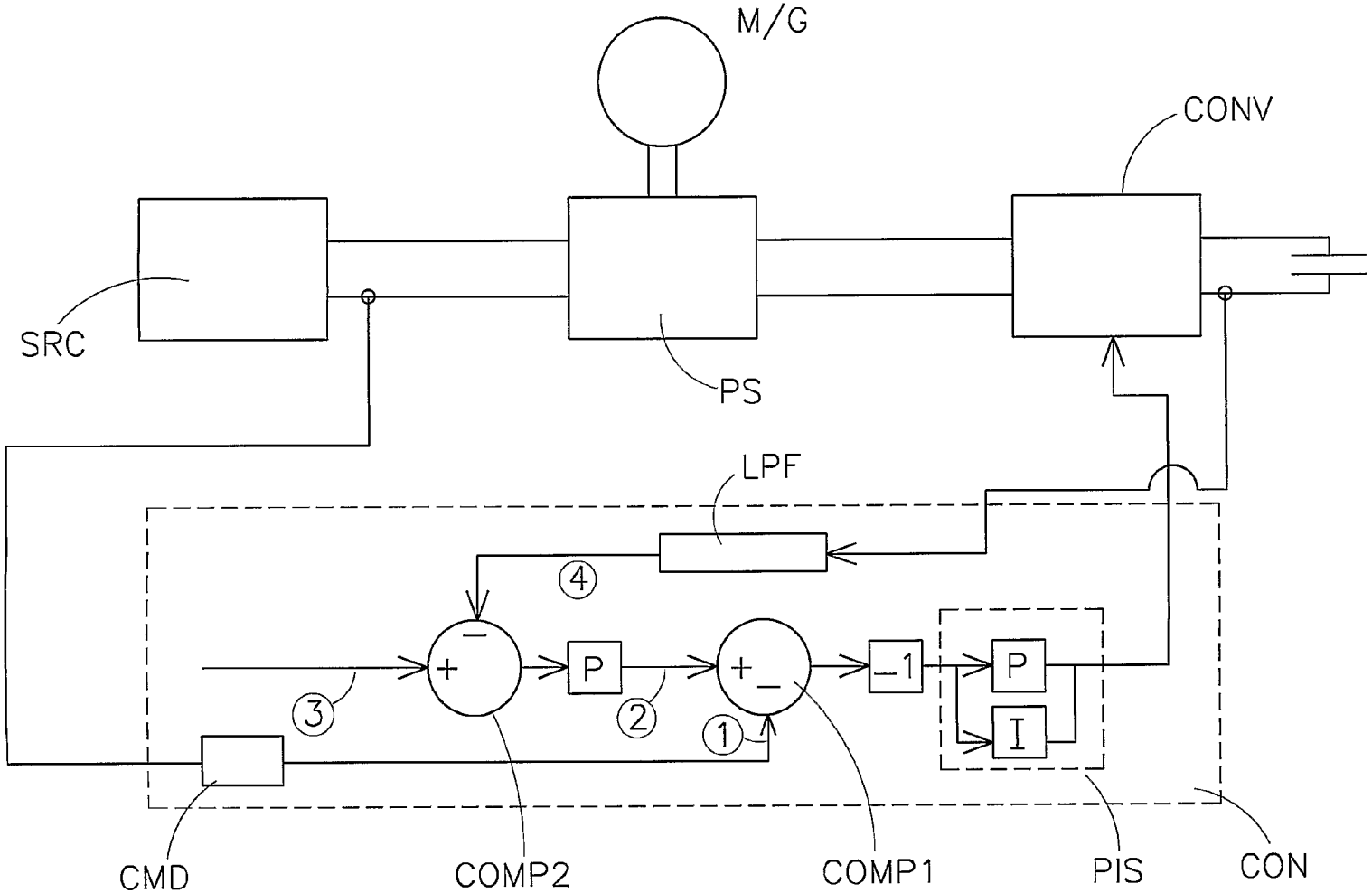
Figure 9B:
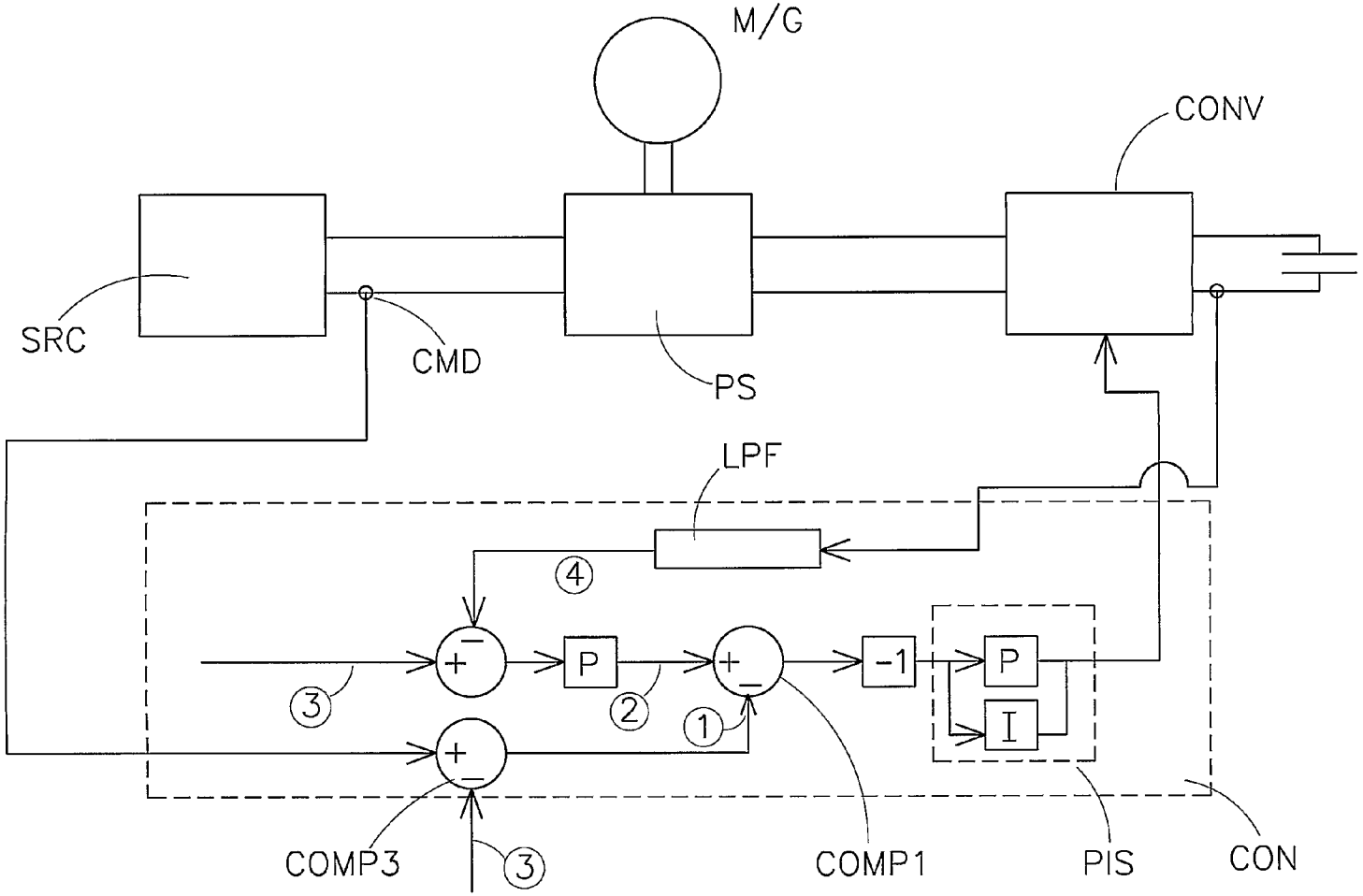
Figure 10:
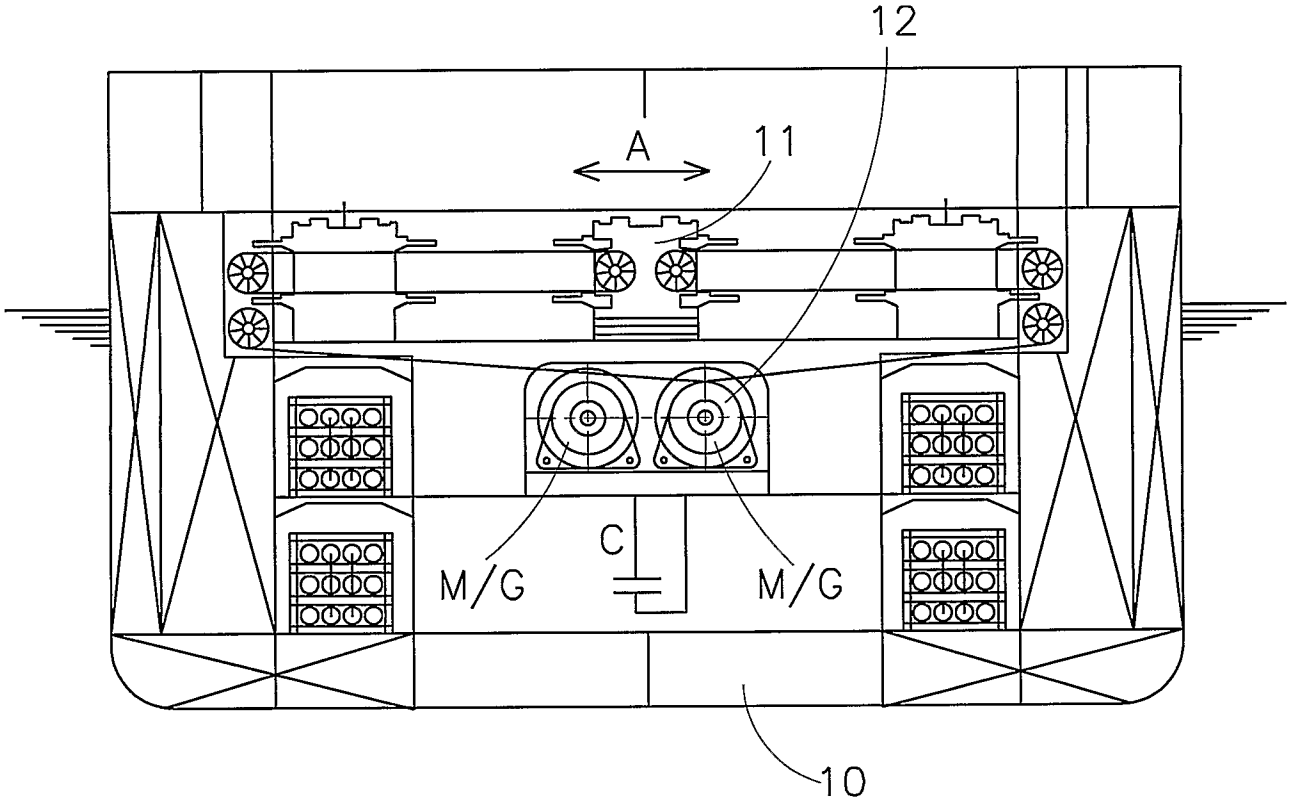

FIG. 9*a* depicts a functional layout of the control unit according to an aspect of the invention;

FIG. 9*b* depicts another functional layout of the control unit according to an aspect of the invention; and FIG. 10 shows a schematic cross section of a vessel with solid roll damping ballast.

Figure 1:
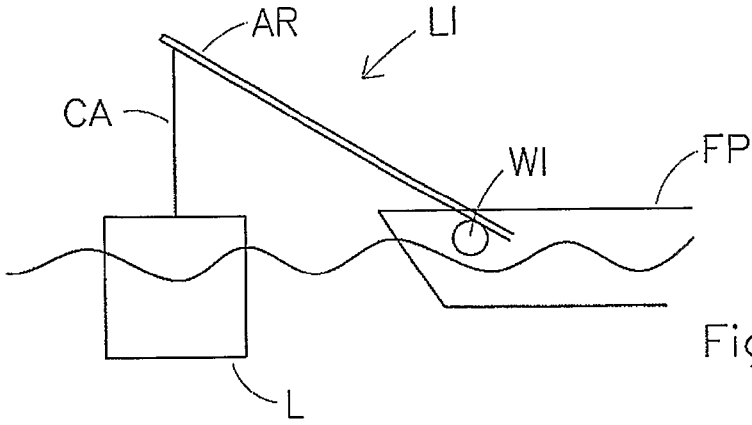
FIG. 1 shows a highly schematic configuration of a load submerged from a floating platform.

FIG. 1 shows a highly schematic view of a partly submerged load L held by a lifting installation LI such as a crane, the lifting installation LI being positioned on a floating platform FP such as a ship. The wave motion will result in vertical forces, thereby providing a periodic vertical movement of the load L as well as the floating platform FP. As a result thereof, forces will act periodically on the cable CA of the lifting installation LI. The heave compensation is intended to compensate for the wave cycle movements, to thereby avoid possible damage of the load, overloading the cable CA of the lifting installation LI, etc. Although in FIG. 1 an example is shown where both the load and the platform holding the lifting installation LI are partly submerged, it is also possible that one of the load and the lifting installation is fixedly mounted, as an example the lifting installation may be mounted on a wharf, or the load is to be placed on the wharf while the lifting installation is mounted on a floating platform. Many other configurations are possible. For example, the load is submerged and is required to be stabilised, while the floating platform holding the lifting installation is subjected to the wave motion. The cable CA is wound on winch WI. Actuating the winch WI to wind up the cable CA will lift the load L and vice versa.

Figure 2:
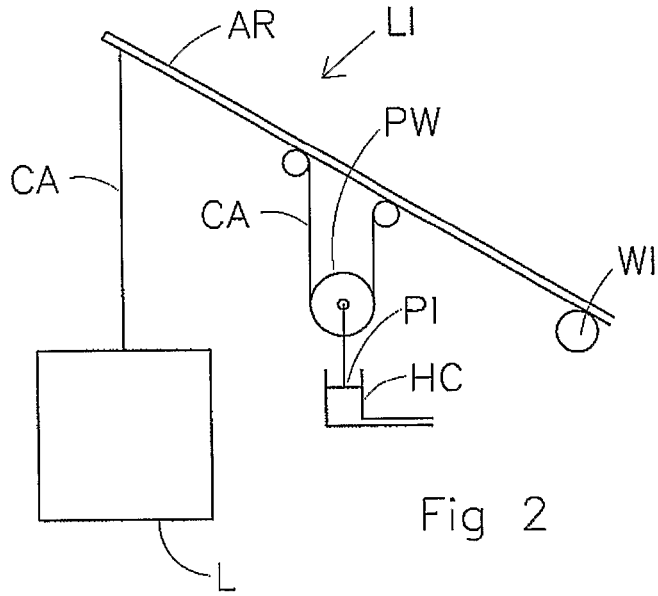
FIG. 2 shows a highly schematic heave installation having a compensation.

FIG. 2 highly schematically shows an example of a construction that may be applied in a conventional heave compensation system again showing the lifting installation LI having a cable CA holding a load L. The cable CA is guided via a pulley wheel PW which is connected to a hydraulic cylinder HC. By downwardly moving a piston PI of the hydraulic cylinder HC, the pulley wheel which is connected to the piston, is also moved downwardly. Thereby, a length of a loop of the cable CA guided via the pulley wheel PW is altered in length, which will cause the load to be lifted respectively lowered depending on the direction of movement of the piston PI. The hydraulic cylinder HC may be actively driven, thereby obtaining an active heave compensation system. Also, or in addition thereto, it is possible that use is made of a gas spring, e.g. formed by an enclosed volume with compressible gas, which acts on a hydraulic system of which the hydraulic cylinder HC forms part.

Figure 3:
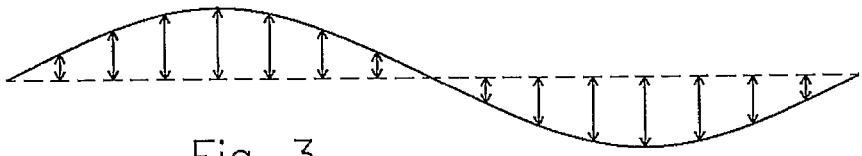
FIG. 3 shows a highly schematic representation of a wave motion.

As schematically illustrated in FIG. 3, a wave motion cycle will result in a periodic pattern of upward and downward forces on either the load, the lifting installation, or both.

Figure 4:
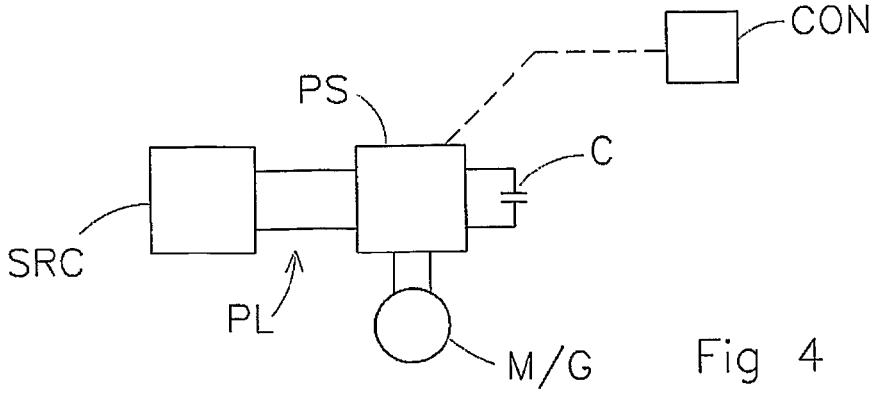
FIG. 4 shows a highly schematic representation of a wave motion compensation according to an aspect of the invention.

FIG. 4 highly schematically shows a part of a active heave compensation system according to the invention. A motor-generator M/G is driven by a power supply PS, such as an inverter. The power supply PS is powered by a power line PL (such as an electrical power network) provided with electrical power by a power source SRC, such as a generator. The power supply PS is controlled by a controller CON, which may comprise any suitable control means, such as a microcontroller, microprocessor, logic electronic circuits or any other programmable logic device. A connection between the controller CON and the power supply PS is schematically indicated by an interrupted line. Any kind of connection can be provided, such as a serial or parallel data bus, a control line, a glassfiber, or any suitable connection. The motor-generator M/G may interact with the load as shown in FIGS. 1 and 2, in any way. In a preferred embodiment, the motor-generator M/G acts on the winch WI on which the cable CA is wound. The motor-generator M/G may e.g. drive the winch WI, however many other configurations are imaginable. It is for example possible that the motor-generator acts on arm AR of the lifting installation, for example by lifting and lowering the arm, and/or extending a length thereof.

FIG. 4 further shows an energy storage element, in this example a capacitor, such as a super capacitor. Although in FIG. 4 only a single capacitor has been shown, the capacitor may comprise a combination of a plurality of (super) capacitors in series connection, parallel connection or any suitable combination thereof. In a first part of the wave motion cycle, the control unit CON controls the power supply PS to provide electrical energy to the motor-generator, thereby causing the motor-generator to act on the load, thereby providing energy to the load. In a second part of the wave motion cycle, the control unit CON controls the power supply such as to have the motor-generator regenerate at least part of the energy with which the load has been driven in the first part of the wave motion cycle. The motor-generator now acts as a generator. Effectively, in the first part of the wave motion cycle, energy is provided to the load for stabilisation, while in the second part of the wave form, at least part of the energy is regenerated by the motor-generator, the regenerated energy being stored at least partly in the electrical storage element. The energy thus stored may now be used in a first part of a following wave motion cycle for powering the motor-generator. Thereby, use of a hydraulic system including its associated disadvantages such as complexity, risk of leakage, requirements for regular maintenance, etc., may be avoided, while on the other hand a compact, low cost and/or low maintenance configuration may be obtained. Furthermore, energy consumption of the heave compensation system may be reduced by the regeneration of energy.

The control unit may be formed by a separate control unit, however, it is also possible that the control unit forms part of an existing control unit of the lifting installation or of any other installation. It is for example possible that the control unit is provided with sensors to sense the wave motion, the sensors thereby providing a suitable signal to the control unit to enable it to control the motor-generator accordingly.

The power supply may comprise any suitable configuration for powering the motor-generator: as an example, the power supply PS may comprise an inverter. Many alternatives are possible: it is for example imaginable that the power supply comprises a plurality of switches to electrically connect the motor-generator either the power line PL and/or with the capacitor C for storing energy. Many implementations are possible, some of which will be described below.

Figure 5:
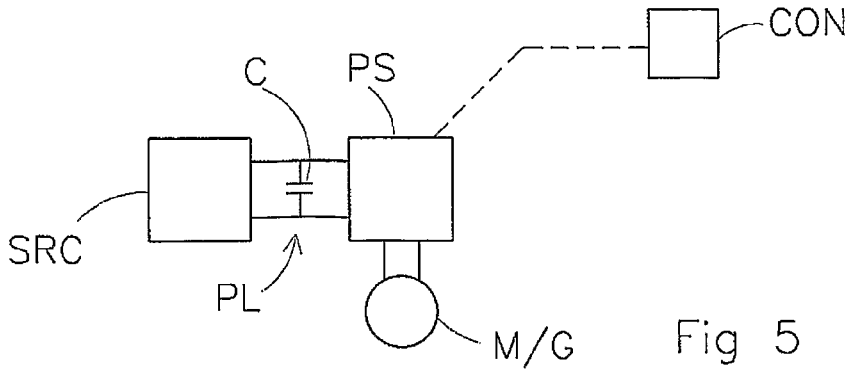
FIG. 5 shows another embodiment of a heave compensation according to the invention.

FIG. 5 shows a highly schematic view of a possible embodiment of the heave compensation according to an aspect of the invention. Here, again the control unit CON controls the power supply PS to drive the motor-generator. The power supply PS is provided with electrical energy via the power line PL from the power source SRC. In FIG. 5 the electrical storage element, in this example the (super) capacitor is connected in parallel to the power source SRC. Thereby, the (super) capacitor C effectively buffers the power source SRC and the power line PL.

Thus, in the first part of the wave motion cycle, the energy storage element is at least partly discharged, while in the second part of the wave motion cycle, energy that is regenerated by the motor-generator is buffered by the energy storage element. As a consequence, in the setup according to FIG. 5, many elements of a conventional winch drive motor and power supply may still be used, while peaks and dips of the supply voltage at the power line may be smoothened by the buffering by the energy storage element, as when power is drawn by the motor-generator, which may cause the power line voltage to drop, energy is drawn from the energy storage element, such as the super capacitor, while when energy is regenerated, causing the power line voltage to increase, energy is stored in the energy storage element. Thus, with the configuration according to FIG. 5, an existing winch drive motor can relatively be adapted such as to provide for the heave compensation, thereby obviating the need for additional hydraulic systems according to the state of the art.

Figure 6:
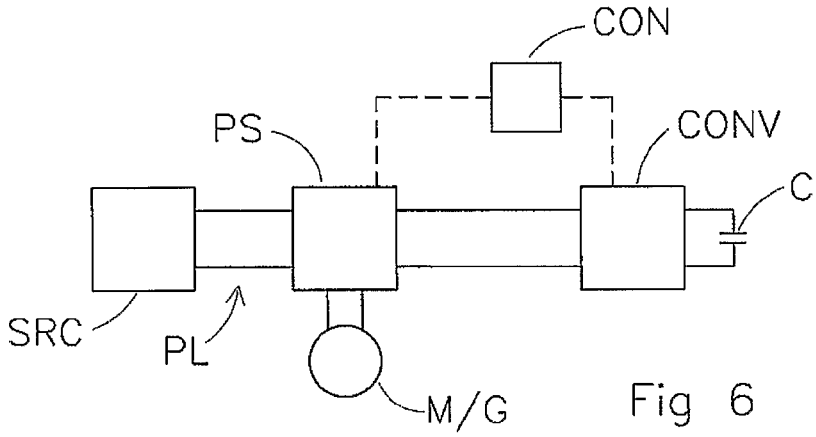
FIG. 6 shows yet another embodiment of the heave compensation according to the invention.

A further example is shown in FIG. 6, where again the motor-generator is powered by a power supply PS which is provided with electronic energy via the power line PL from the power source SRC. The power supply PS is controlled by control unit CON. A converter CONV is provided and connected between the power supply PS and the energy storage element, in this example a capacitor or super capacitor. The converter CONV is controlled by the control unit CON. The converter, under control of the control unit, to convert a motor-generator voltage or a power supply voltage into a charging voltage of the storage element. Further, the converter is arranged to discharge the energy storage element, and convert the discharging voltage-current into a power supply voltage of motor-generator voltage for powering the motor-generator. Thereby, the energy storage element may be used over a wide operating voltage range, as a conversion into a suitable charging/discharging voltage is provided for by the converter CONV. Consequently, a large amount of electrical energy may be buffered by the energy storage element. The converter may comprise any type of converter, as an example a bidirectional direct current-direct current converter may be provided, to enable a low loss conversion.

Figure 7A:
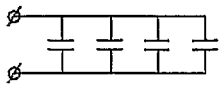
FIG. 7A-7C depict capacitor configurations according to an aspect of the invention.
Figure 7B:
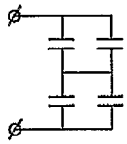
Figure 7C:
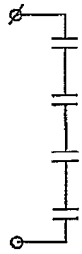
Figure 8:
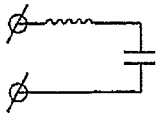
FIG. 8 depicts a resonance circuit according to an aspect of the invention.

FIG. 7A-7C depict a parallel configuration, parallel/series configuration and a series configuration respectively of (super) capacitors contained in the energy storage element according to an embodiment of the invention. A converter having a switching network may be provided to switch the (super) capacitors such as to be in the configurations according to FIGS. 7A-7C. By such switching network (not shown), a wider operating voltage range may be obtained: when a charging voltage provided to the super capacitors low, the super capacitors may be connected in the configuration according to FIG. 7A, while the higher the charging voltage gets, first the converter switches to the configuration according to FIG. 7B, and then to the configuration according to FIG. 7C. Thereby, a larger charging voltage range may be handled by the super capacitors. It is to be understood that the embodiments in FIG. 7A-7C are for illustrative purposes only: in a practical implementation, use may be made of a larger amount of super capacitors, thereby providing possibilities for many series/parallel connections and combinations thereof. Also a combination with one or more batteries in a serial and/or parallel connection may be a practical implementation FIG. 8 schematically indicates a further possible embodiment of the converter and energy storage element. In this embodiment, the converter comprises a conductor to form a resonance circuit with the (super) capacitor, a resonance frequency of the resonance circuit being adapted to a cycle frequency of the wave motion to thereby facilitate a cycle of providing energy and regenerating energy. Adaptation of the resonance frequency to the cycle frequency of the wave motion may take place by switching more or less capacitors to the energy storage element by means of a suitable switching network (not shown) to thereby alter a total capacitance value.

In a further embodiment, the control unit may comprise a voltage measurement device for measuring a voltage of the power line PL or power source SRC. The measured voltage is then compared by the control unit, by a suitable comparator thereof, with a low threshold voltage and a high threshold voltage value. The converter (such as the converter in FIG. 6) is then driven by the control unit for charging the electrical storage element when the measured voltage exceeds a high threshold voltage value—which provides an indication of a regeneration of energy—, and for discharging the electrical storage element when the measured voltage succeeds the low threshold voltage, thereby an indication that energy is drawn from the power source SRC to power the motor-generator. As a consequence, the converter may thereby reduce peaks and dips on the power line voltage caused by the cyclic operation of the motor-generator.

In a further embodiment, the control unit may comprise a current measurement device for measuring a current of power source SRC. After comparison with a current set point (which is discussed below) the control unit will then drive the converter CONV in order to discharge the electrical storage element when the measured current exceeds the current set point and in order to charge the electrical storage element the current set point exceeds the measured current. A high supply current (i.e. higher than average) would indicate that a high current is drawn by the motor. In that case, it would be advantageous if the electrical storage element is discharged and provides energy for driving the motor-generator. In case the power supply current is low (i.e. lower than average), the converter may be operated to charge the (super) capacitor.

In FIG. 9*a* an example of a functional layout of such a control unit is depicted. The current measurement device CMD measures the current supplied by the power source SRC. Its value is fed to the control unit. Below, the functional layout of the control unit will first be discussed without taking in account input 2 to comparator COMP1, i.e. its value is regarded as zero. The value of the measured current of power source SRC is fed to COMP1. Its output is inverted and via a proportional integral (PI) system PIS fed to the converter. This may drive the converter to drive the energy storage to supply more energy when the power source is supplying energy. In turn, the power source will then provide less energy. In this way, the energy provided by the power source may be minimized. The PI system PIS will enable rapid responses to the changes in the measured current. All time delays in this loop are minimized and the P action of the controller gives a direct response to the converter. This part of the control unit can be referred to the fast current control loop.

Since energy losses will occur in the cables, converters and motor-generators, the energy level of the energy storage will decrease even in the case of a perfect wave compensation. Therefore, the powers source should compensate for these losses. This can be accomplished by the "slow voltage control loop". A function of such slow voltage control loop may be to control the voltage of the capacitors around the constant desired operating voltage of the storage element. This predefined storage voltage set point (input 3 in FIG. 9*a*) is fed to comparator COMP2 as well as a time average (input 4) of the voltage of the storage element. The time average of the voltage of the storage element can be obtained by passing the measured voltage of the storage element through a low pass filter LPF. Thereby, COMP2 may not react on fast movements (like heave motions) but it may react on changes with a larger time constant, such as average losses of the system or prolonged hoist movements. The difference of the predefined storage voltage set point and the time average of the voltage of the storage element is then fed, through a P control block to comparator COMP1 as the current set point. The slow voltage control loop will enable that the energy storage is provided with energy from the power source, when the operating voltage of the energy storage is below the desired value.

It may be advantageous to take in account the expected heave compensation. This would yield a faster response and thereby a more effective compensation, i.e. less energy losses. The expected heave compensation may be calculated on the basis of measurements of waves, tractive forces on the load, and/or acceleration of the driving axes of the motor-generator. Also the movements of the ship itself may be used to calculate an expected heave compensation. A value representative of the expected heave compensation (input 3 in FIG. 9*b*) may be fed to yet another comparator COMP3. In this way, for example, when it is expected that energy is needed by motor-generator, the control unit may start to drive the converter to supply energy to the motor-generator, in a faster way than without taking into account the expected heave compensation.

In all above embodiments, as well as in any other possible embodiment, an electrical power dissipater, such as a resistor or any power consuming device, may be connected to the electrical storage element for dissipation of energy, when the operating voltage of the electrical storage element would exceed a maximum operating voltage. Thereby, safe operation of the electrical storage element may be provided for. In other embodiment, safe operation is established by feeding back the excess of energy to the power source.

Since all electrical devices described in the embodiments above have their own operating characteristics for safe operation, it can be understood that several control systems can be applied to measure the operation voltages and currents and to take action when safe operation is in danger. Devices can, for example, be disconnected from the system when voltages are too high. These safety control systems have not been shown in the figure or described for clarity reasons.

In the context of this document, the term "heave compensation" is to be understood as to comprise any form of wave motion compensation, including among others vertical movement compensation, horizontal movement compensation and roll compensation.

It may also be understood that use of a super capacitor, possibly in combination with a "slow voltage control loop" and a "fast voltage control loop", as described above may be advantageous for other systems where, in one part of a cycle, energy is required, while in another part of the cycle energy is produced and stored.

An example of such a system is described in the international patent application PCT/NL2008/000221. It discloses a mono hull vessel with a heavy lift crane. In FIG. 10 a schematic cross section of the vessel is depicted. The vessel 10 is provided with an active roll damping mechanism. The active roll damping mechanism comprises a solid roll damping ballast 11 which is movable in the transverse direction of the hull (direction indicated by arrow A), a sensor detecting the rolling motion of the hull, and a drive and control system 12 operable to cause and control the movements of the solid roll damping ballast in response to the detections of the sensor to provide roll stabilization.

The drive and control system may be provided with a motor/generator M/G and a energy storage C (such as a super capacitor with a converter) as described above to drive the solid roll damping mechanism. The movements of the solid roll damping ballast can be described as cycle, as the ballast may be moved from larboard to starboard and vice versa. In the cycle, energy may be produced and stored in a first part the cycle and may be required in another part.

Any of the above mentioned embodiments according to the invention may be applied on the active roll damping mechanism, the motor/generator M/G and the energy storage C. In particular, a "slow voltage control loop" and a "fast voltage control loop" may be applied to control buffering of energy in the energy storage and providing energy from the energy storage to drive the motor/generator, which is driving the solid roll damping ballast.

It may be understood from the above, that similar embodiments may be applied to other kind of ships, such as drill ships. Since drill ships are often positioned at one position in the ocean, they may experience rolling of the ship as a disturbing factor. A anti-rolling system to counteract the rolling of the drill ship may be based on the roll-stabilization system described above and in the international patent application PCT/NL2008/000221. Also in this case, any of the embodiments of the invention may be applied to drive a motor/generator M/G and a energy storage C, which may comprise a super capacitor, in order to buffer energy in the energy storage and to provide energy from the energy storage to drive the motor/generator, which is driving the solid roll damping ballast.

It may be understood that in the embodiments and applications of the invention as described above, it also possible that a motor interacting with the load is not generating or regenerating energy and that a power supply is providing energy to the energy storage. When the motor requires energy, the energy storage may provide at least a part of the energy required by the motor to interact with the load. Thus, the energy required by the motor is provided completely by the power supply, for example in a continuous way during the whole cycle. In the cycle part, when the motor does not require energy, the energy provided by the power supply is stored in the energy storage. In the cycle part, when the motor requires energy, the energy is provided at least for a part by the energy storage.

Therefore, an active heave compensation system may be provided comprising a motor to interact with a load;

a control unit which is arranged to control operation of the motor, the control unit being arranged to operate the motor to drive the load in a first part of a wave motion cycle; and an electrical storage element arranged and electrically connected to the motor for buffering energy for powering the motor in a following cycle of the wave motion.

This compensation system may also be applied compensate for roll movements, i.e. an anti-rolling system as is described above and in the international patent application PCT/NL2008/000221. Other embodiments of the invention may also be applied to this active heave compensation or anti-rolling system.

The invention claimed is:

1. An active heave compensation system comprising:

a control unit;

an electric motor-generator configured to interact with a load and the control unit, wherein the control unit is arranged to control operation of the electric motor-generator, the control unit being arranged to:

operate the electric motor-generator to drive the load in a first part of a wave motion cycle, and operate the electric motor-generator to regenerate in a second part of the wave motion cycle at least a part of the energy with which the load has been driven in the first part of the wave motion cycle; and an electrical storage element configured to buffer at least part of the regenerated energy for powering the electric motor-generator in a following cycle of the wave motion, wherein the electric motor-generator is configured to function as an electric motor to convert electrical energy into mechanical energy for driving the load in the first part of a wave motion cycle, and is configured to function as an electric generator to regenerate said at least a part of the electrical energy in the second part of the wave motion cycle when mechanically driven by a corresponding motion of the load.

2. The active heave compensation system according to claim 1, wherein the electrical storage element comprises a capacitor.

3. The active heave compensation system according to claim 1, wherein the electrical storage element comprises a battery or a combination of a battery and a capacitor.

4. The active heave compensation system according to claim 1, wherein the storage element is electrically connected in parallel to an electrical power source to power the motor-generator.

5. The active heave compensation system according to claim 1, wherein a converter is electrically connected between the motor-generator and the storage element, the converter to convert a motor-generator voltage into a charging respectively discharging voltage of the storage element and vice versa.

6. The active heave compensation system according to claim 5, wherein the converter comprises a bidirectional direct current-direct current converter.

7. The active heave compensation system according to claim 5, wherein the storage element comprises a plurality of capacitors and wherein the converter comprises a switching network to switch the capacitors in series- and/or parallel combinations.

8. The active heave compensation system according to claim 5, wherein the storage element comprises the super capacitor and wherein the converter comprises an inductor to form an inductor-capacitor resonance circuit with the super capacitor, a resonance frequency of the resonance circuit being adapted to a cycle frequency of the wave motion.

9. The active heave compensation system according to claim 5, wherein the control unit comprises a voltage measurement device for measuring a voltage of the power source, the control unit being arranged for comparing the measured voltage with a low and a high threshold voltage value, for driving the converter in order to charge the electrical storage element when the measured voltage exceeds the high threshold voltage value, and in order to discharge the electrical storage element when the measured voltage succeeds the low threshold voltage.

10. The active heave compensation system according to claim 5, wherein the control unit comprises a current measurement device for measuring a current of the power source, the control unit being arranged for comparing the measured current with a current set point, for driving the converter in order to discharge the electrical storage element when the measured current exceeds the current set point and in order to charge the electrical storage element the current set point exceeds the measured current.

11. The active heave control system according to claim 1, wherein the control unit is arranged to measure an operating voltage of the electrical storage element and to connect an electrical power dissipater when the operating voltage of the electrical storage element exceeds a maximum operating voltage.

12. The active heave control system according to claim 4, wherein the power source comprises a supply control unit and wherein the control unit is arranged to measure an operating voltage of the electrical storage element and to operate the supply control unit to supply electrical power to the power source when the operating voltage of the electrical storage element exceeds a maximum operating voltage.

13. The active heave compensation system according to claim 10, wherein the control unit is arranged for comparing a time average of the voltage of the storage element with a predefined storage voltage set point, and for modifying the current set point on the basis of the comparison.

14. The active heave compensation system according to claim 5, wherein the control unit comprises a measurement device for measuring a variable, representative of a heave motion to be compensated, the control unit being arranged for driving the converter in order to charge or discharge the electrical storage element to provide or to buffer at least a part of the electrical energy involved with the heave compensation on the basis of the measured variable.

15. The active heave compensation system according to claims 14 wherein the control unit is arranged for driving the power source to provide or to receive at least a part of the electrical energy involved with the heave compensation.

16. The active heave compensation system according to claim 14, wherein the variable is a wave variable, a heaving variable or a motor-generator variable.

17. The active heave compensation system according to claim 1, wherein the load comprises a solid roll damping ballast which is movable in a transverse direction of a hull.

18. An active heave compensation method for at least partly compensating for an effect of a wave motion on a load, the method comprising the steps of:

operating an electric motor-generator which interacts with the load to drive the load in a first part of a wave motion cycle;

operating the electric motor-generator to regenerate in a second part of the wave motion cycle at least a part of the energy with which the load has been driven in the first part of the wave motion cycle; and providing an electrical storage element configured to buffer at least part of the regenerated energy for powering the motor-generator in a following cycle of the wave motion, wherein the electric motor-generator is configured to function as an electric motor to convert electrical energy into mechanical energy for driving the load in the first part of a wave motion cycle, and is configured to function as an electric generator to regenerate said at least a part of the electrical energy in the second part of the wave motion cycle when mechanically driven by a corresponding motion of the load.

19. The active heave compensation system according to claim 2, wherein the capacitor is a super capacitor.

20. The active heave compensation system according to claim 3, wherein the capacitor is a super capacitor.

* * * * *